US011187512B1

(12) United States Patent
Foltz et al.

(10) Patent No.: US 11,187,512 B1
(45) Date of Patent: Nov. 30, 2021

(54) APPARATUS FOR DETONATING MUNITIONS

(71) Applicant: The United States of America as Represented by the Secretary of the Navy, Indian Head, MD (US)

(72) Inventors: Lee Foltz, Indian Head, MD (US); Daniel McCarthy, LaPlata, MD (US); Ray McGuire, Alexandria, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 195 days.

(21) Appl. No.: 16/602,214

(22) Filed: Aug. 29, 2019

(51) Int. Cl.

| | |
|---|---|
| ***F42D 5/04*** | (2006.01) |
| ***F42D 3/00*** | (2006.01) |
| ***F42B 3/00*** | (2006.01) |
| ***F42B 3/08*** | (2006.01) |
| ***F42B 33/06*** | (2006.01) |
| ***F42D 5/045*** | (2006.01) |

(52) U.S. Cl.
CPC ..... *F42D 5/04* (2013.01); *F42B 3/00* (2013.01); *F42B 3/08* (2013.01); *F42B 33/06* (2013.01); *F42D 3/00* (2013.01); *F42D 5/045* (2013.01)

(58) Field of Classification Search
CPC .... F42B 1/00; F42B 1/02; F42B 1/028; F42B 3/00; F42B 3/08; F42B 3/22; F42B 33/06; F42B 33/067; F42B 99/00; F42D 1/00; F42D 3/00; F42D 3/02; F42D 5/04; F42D 5/045; F42D 99/00
USPC ..... 86/50; 102/305, 306, 307, 331, 332
See application file for complete search history.

(56) References Cited

U.S. PATENT DOCUMENTS

| | | | | |
|---|---|---|---|---|
| 3,109,369 A * | 11/1963 | Plumley | F42B 3/00 86/50 |
| 3,117,518 A * | 1/1964 | Porter | F42B 3/08 102/307 |
| 4,387,773 A | 6/1983 | McPhee | |
| 7,861,655 B2 * | 1/2011 | Zhang | F42D 3/00 102/475 |
| 9,045,692 B2 | 6/2015 | Lumley | |

(Continued)

FOREIGN PATENT DOCUMENTS

| | | | |
|---|---|---|---|
| GB | 2295664 | 6/1996 | |
| GB | 2295664 A * | 6/1996 | F42B 1/032 |
| JP | 2005233459 A * | 9/2005 | F42B 33/06 |

*Primary Examiner* — James S Bergin
(74) *Attorney, Agent, or Firm* — Fredric J. Zimmerman

(57) ABSTRACT

An apparatus for detonating a munition having a munition casing. The apparatus includes a pyramidal shaped housing with an interior to receive explosive material and a stepped structure defining a plurality of tier sections. The housing includes a bottom portion and an interior space to receive an energetic device. A force-reactive component secured to the bottom portion of the housing confronts the munition casing and includes a force-receiving portion exposed to the housing interior. The force-reactive component impacts the munition casing when a force is exerted upon the force-receiving portion. After the apparatus is positioned on the casing, explosive material is packed into the housing interior and an energetic device disposed within the additional space, the energetic device is detonated and the force-reactive component impacts the munition casing where shock waves permeate the munition casing and detonate the munition.

21 Claims, 12 Drawing Sheets

(56) References Cited

U.S. PATENT DOCUMENTS

| | | | | |
|---|---|---|---|---|
| 9,303,961 | B1 | 4/2016 | Frericks et al. | |
| 9,395,128 | B2 * | 7/2016 | Treadway | F42B 3/22 |
| 9,829,296 | B1 * | 11/2017 | Askin | F42D 5/04 |
| 9,835,014 | B2 * | 12/2017 | Dai | F42B 1/02 |
| 10,267,127 | B2 * | 4/2019 | Geerts | E21B 43/1185 |
| 10,982,936 | B2 * | 4/2021 | Lumley | F42B 3/087 |
| 11,022,410 | B2 * | 6/2021 | Lumley | F42B 1/032 |
| 2011/0232519 | A1 | 9/2011 | Sagebiel | |
| 2017/0074624 | A1 | 3/2017 | Collier | |
| 2017/0199017 | A1 | 7/2017 | McDonald et al. | |
| 2018/0193909 | A1 | 7/2018 | Loehken | |
| 2018/0202779 | A1 | 7/2018 | McNelis et al. | |
| 2018/0216445 | A1 | 8/2018 | Collins et al. | |

* cited by examiner 60
62
62A
62F
62B
60A
62C
60B
62D
62E
60A
60B
62A
62D
62C
62E
62B

APPARATUS FOR DETONATING MUNITIONS

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

FIELD OF THE INVENTION

The present invention relates to an apparatus for detonating munitions.

BACKGROUND

As a result of military operations or attempted terrorist attacks, it is often necessary to destroy unused or unexploded munitions or other explosive devices. Several conventional methods for destroying munitions and explosive devices rely on multiple initiation points with small diameter discs that are used to impact the surface of the munition thereby creating a sharp, high velocity impact causing detonation of the munition or explosive device. A limitation of such a conventional technique is that it requires placement or positioning of multiple blasting caps or other energetic devices at predetermined locations on the munition or explosive device. Such a technique is time consuming and expensive to implement.

What is needed is a new and improved apparatus for detonating munitions or explosive devices which is cost effective and which can be implemented in a time efficient manner.

SUMMARY OF THE INVENTION

The present invention is directed to an apparatus for detonating a munition. An important advantage of the apparatus is that it minimizes the amount of energetic devices needed to destroy the munition. In some exemplary embodiments, the apparatus is configured to be positioned on a munition casing. The apparatus comprises a pyramidal shaped housing, which includes a hollow interior configured for receiving an explosive material and a stepped structure defining a plurality of tier sections. The plurality of tier sections comprises a base tier section, an upper tier section and at least one intermediate tier section. The base tier section is relatively larger in size than both the intermediate tier section and the upper tier section, and wherein the intermediate tier section is relatively larger in size than the upper tier section. The pyramidal shaped housing includes a bottom portion contiguous with the base tier section and also includes an additional space that is part of the interior, and which is configured to receive an energetic device. The apparatus includes a force-reactive component secured to the bottom portion of the housing so that the force-reactive component confronts the munition casing. The force-reactive component includes a force-receiving portion exposed to the interior of the pyramidal shaped housing. The force-reactive component is configured to impact the munition casing when a force is exerted upon the force-receiving portion. Whereby, when the apparatus is positioned on the munition casing and explosive material is packed into the hollow interior of the pyramidal shaped housing and an energetic device is disposed within the additional space, the detonation of the energetic device causes detonation of the explosive material and causes the force-reactive component to impact the munition casing. The impact of the force-reactive component on the munition casing produces shock waves that permeate the munition casing and cause the munition to detonate. Stated another way, the force-reactive component functions as a flyer plate that slaps the exterior surface of the munition casing so as to produce the shock waves.

Certain features and advantages of the present invention have been generally described in this summary section. However, additional features, advantages and exemplary embodiments are presented herein or will be apparent to one of ordinary skill of the art in view of the drawings, specification and claims hereof. Accordingly, it should be understood that the scope of the invention shall not be limited by the particular embodiments disclosed in this summary section.

BRIEF DESCRIPTION OF THE DRAWINGS

FIG. 6C is an exploded view showing the arrangement of the portions of the plastic explosive material when packed into the interior of the pyramidal shaped housing having the first predetermined size;

DETAILED DESCRIPTION OF EXEMPLARY EMBODIMENTS OF THE INVENTION

As used herein, the terms "comprises", "comprising", "includes", "including", "has", "having" or any other variation thereof, are intended to cover a non-exclusive inclusion. For example, a process, method, article or apparatus that comprises a list of elements is not necessarily limited to only those elements, but may include other elements not expressly listed or inherent to such process, method, article or apparatus.

It is to be understood that throughout this description, terms such as "vertical", "horizontal", "top", "bottom", "upper", "lower", "middle", "above", "below" and the like are used for convenience in identifying relative locations of various components and surfaces relative to one another in reference to the drawings and that the apparatus of the present invention may be installed and used in substantially any orientation so that these terms are not intended to be limiting in any way.

Approximating language, as used herein throughout the specification and claims, may be applied to modify any quantitative representation that could permissibly vary without resulting in a change in the basic function to which it is related. Accordingly, a value modified by a term such as "about" or "approximately" is not limited to the precise value specified.

As used herein, the term "energetic device" shall refer to explosive and pyrotechnic devices including blasting caps, electro-explosive devices (EED) and any other explosive device which, upon detonation, initiates a secondary detonation of another explosive device.

As used herein, the term "munition" shall refer to explosive devices and ordinance including artillery shells, mortar shells, rockets, missiles, grenades, warheads, vehicle land mines, anti-personnel land mines, floating or water-borne mines, submersible mines, aircraft-deployed bombs, improvised explosive devices (IED) and torpedoes.

Figure 1:
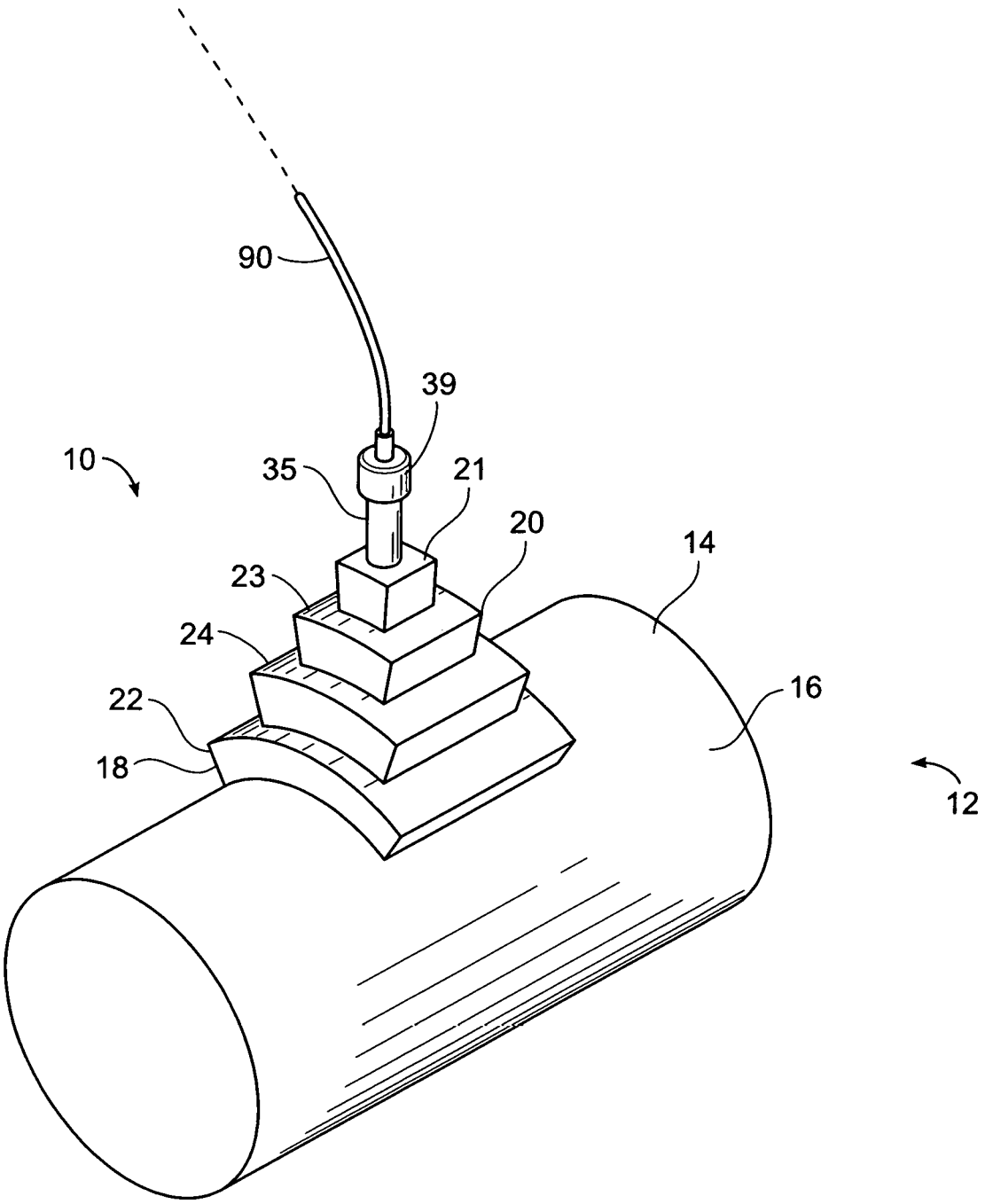
FIG. 1 is a perspective view of an apparatus for detonating munitions in accordance with an exemplary embodiment of the invention, the view showing the apparatus positioned on the casing of a munition that is to be detonated.
Figure 2:
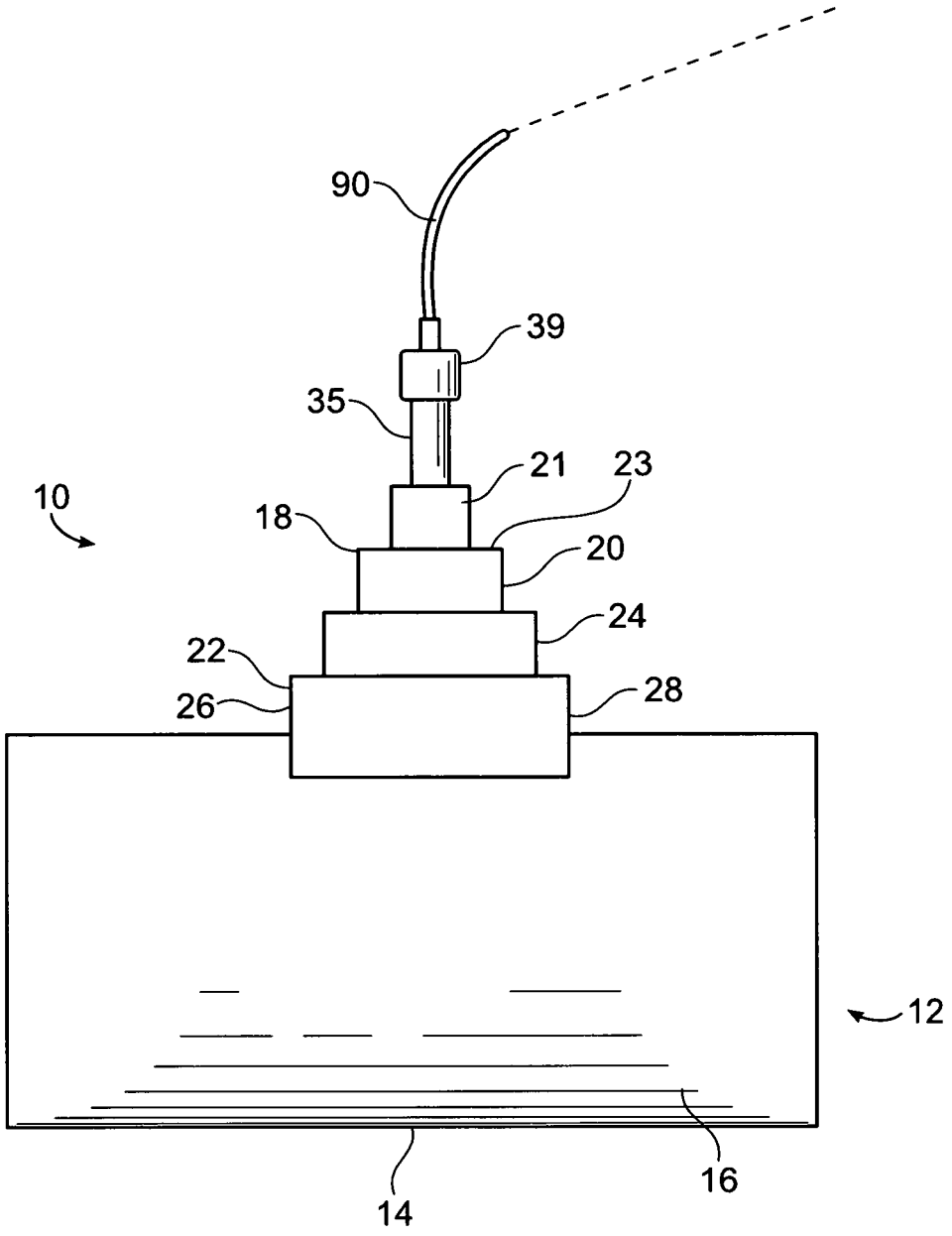
FIG. 2 is a front view of the apparatus and munition, the rear view being essentially the same.
Figure 3A:
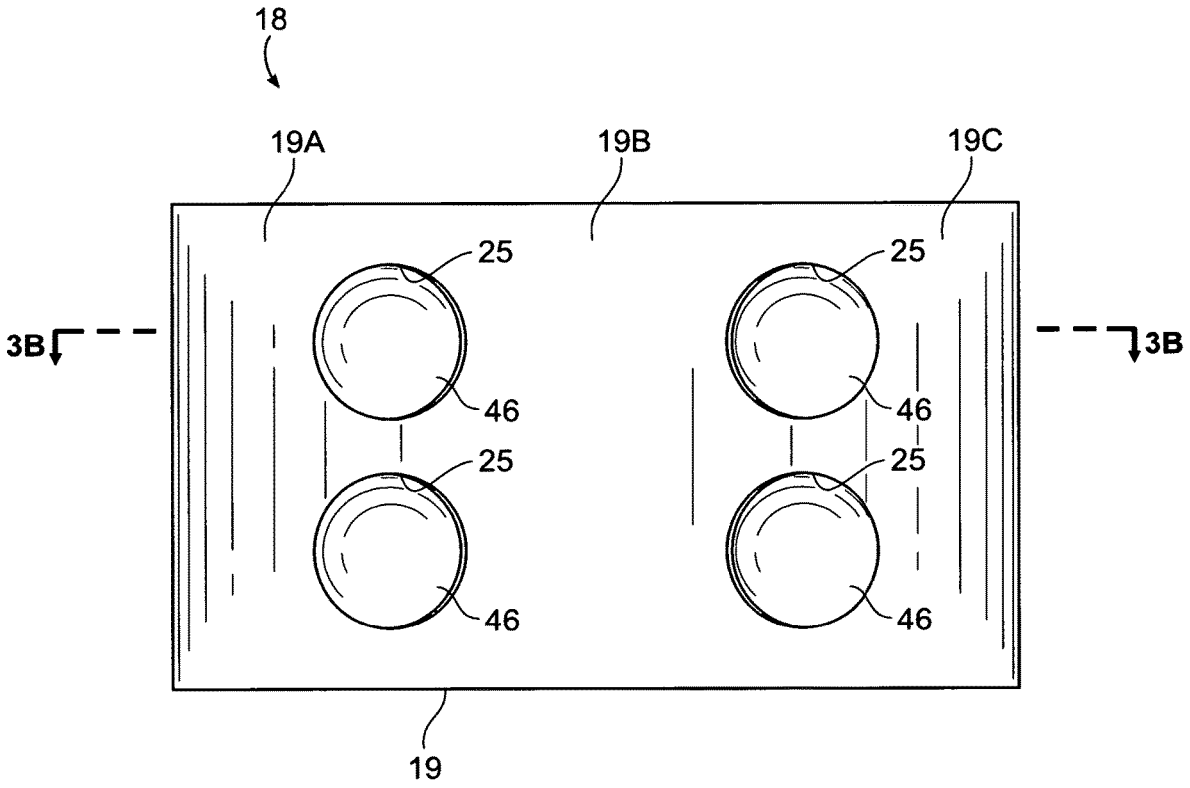
FIG. 3A is a bottom plan view of the apparatus for detonating munitions.
Figure 3B:
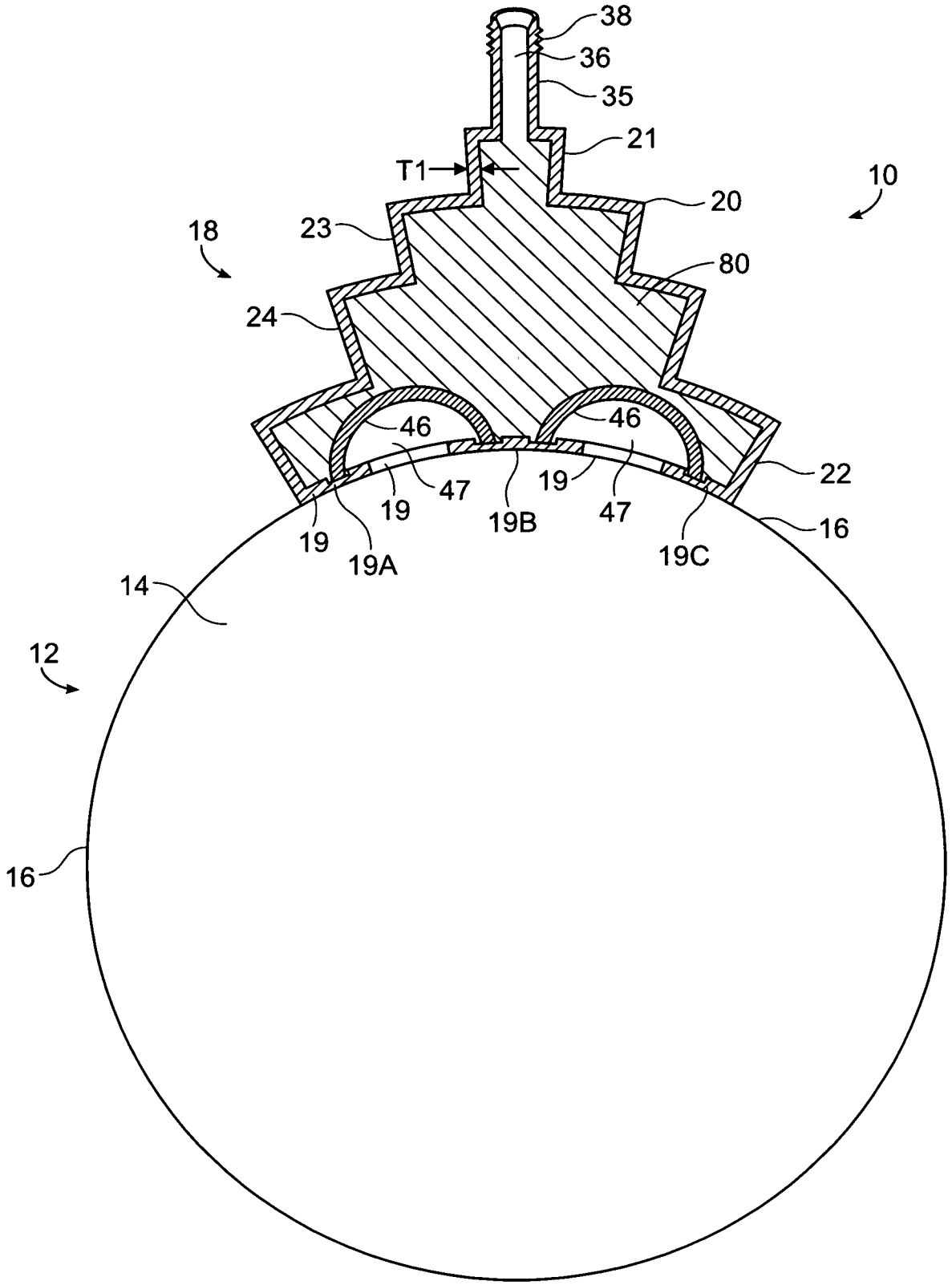
FIG. 3B is an end view showing the apparatus for detonating munitions positioned on top of the munition, the view showing a cross-sectional view of the apparatus taken along line 3B-3B in FIG. 3A.

Referring to FIGS. 1, 2, 3A and 3B, there is shown apparatus 10 for detonating munitions in accordance with an exemplary embodiment of the present invention. Apparatus 10 is positioned or placed on top of munition 12 that is to be detonated. In this example, munition 12 has a generally cylindrical shaped casing or body 14, which has a generally curved exterior surface 16. However, it is to be understood that apparatus 10 may be configured to work with munitions having other geometrical shapes. Apparatus 10 includes housing 18. Housing 18 has a generally pyramidal shape and comprises bottom portion 19. Bottom portion 19 includes sections 19A, 19B and 19C. Housing 18 further includes stepped structure 20 that defines a plurality of tiered sections including an upper tier section 21, a base tier section 22 and intermediate tier sections 23 and 24 that are between upper tier section 21 and base tier section 22. In one exemplary embodiment, bottom portion 19 is integral with base tier section 22. In another embodiment, bottom portion 19 is attached to base tier section 22. Bottom portion 19 includes one or more openings 25 therein. The purpose of openings 25 is described in the ensuing description. As shown in FIGS. 1, 2 and 3B, intermediate tier section 23 is relative larger in size than upper tier section 21, intermediate tier section 24 is relatively larger in size than intermediate tier section 23 and base tier section 22 is relatively larger in size than intermediate tier section 24. In one embodiment, there is only one intermediate tier section. In another exemplary embodiment, there are more than two intermediate tier sections. Base tier section 22 includes wall section 28 and opposite wall section 30 (see FIG. 2). Each tier section of stepped structure 20 has a degree of curvature that corresponds to the curvature of munition casing 14. In an exemplary embodiment, the curvature of base tier section 22 is less than or equal to 60°. Housing 18 made be fabricated from any one of a variety of suitable materials using any suitable technique or method. In an exemplary embodiment, housing 18 is fabricated from acrylonitrile butadiene styrene (ABS). However, other suitable materials may be used to fabricate housing 18, including, but not limited to, plastic, rubber, resin, polyvinyl chloride (PVC) plastic and composite materials. In one embodiment, a 3D printing process is used to form housing 18 out of ABS. Housing 18 is fabricated so as to have hollow interior 34.

As shown in FIGS. 1, 2 and 3B, housing 18 includes extending section 35 that extends vertically from upper tier section 21. Extending section 35 is hollow and includes interior space 36 that is part of hollow interior 34. In one exemplary embodiment, extending section 35 is generally tubular in shape. Extending section 35 further includes an opening that allows access to interior space 36. Interior space 36 is sized to receive energetic device 37 (see FIG. 5). In an exemplary embodiment, energetic device 37 is a blasting cap. However, it is to be understood that energetic device 37 may be realized by any other suitable explosive or pyrotechnic device that can be detonated by electrical signals, shock waves, heat or other stimuli. As will be explained in the ensuing description, interior 34 is packed with an explosive material 80 that is detonated upon detonation of the energetic device 37. Extending section 35 includes threaded portion 38 which is configured to engage the internal threads of a fastening device 39. The purpose of this configuration is described in the ensuing description. The wall of housing 18 may have any suitable thickness. In an exemplary embodiment, the thickness T1 of the wall of housing 18 is about 0.125 inch (see FIG. 3B).

Figure 3C:
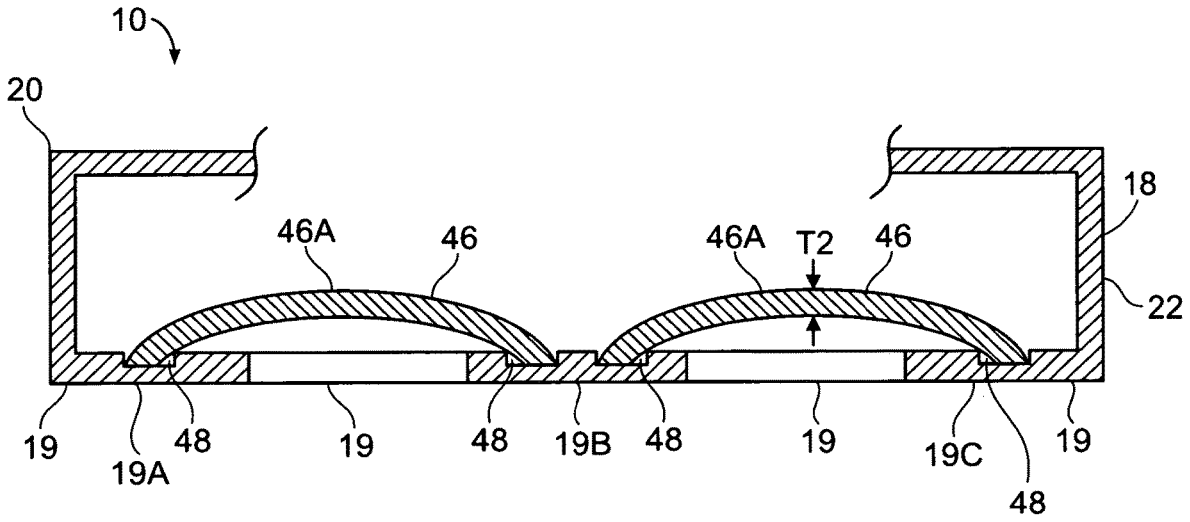
FIG. 3C is an enlarged view of a portion of the view shown in FIG. 3B.

Referring to FIGS. 3A and 3B, in one exemplary embodiment, apparatus 10 includes force-reactive components 46 that are secured to bottom portion 19 of housing 18 and located within interior 34. In an exemplary embodiment, each force-reactive component 46 comprises a disc member. Each disc member 46 has a force-receiving portion 46A that encompasses the peak or apex of disc member 46 and contacts explosive material 80. In an exemplary embodiment, each disc member 46 has a generally arc-shaped geometry. In another embodiment, each disc member 46 has a generally hemispherical shape. In some embodiments, disc members 46 are fabricated from metal. Suitable metals include steel, iron, aluminum, copper, brass and nickel. As shown in FIG. 3C, bottom portion 19 of housing 18 is configured with a plurality of circumferentially extending channels 48. One pair of channels 48 is located on section 19A and section 19B of housing bottom portion 19, and another pair of channels 48 is located on section 19B and section 19C of bottom portion 19. Each channel 48 extends about a corresponding opening 25 in bottom portion 19. Channels 48 are sized to receive the perimetrical edges of disc members 46. As shown in FIGS. 3A and 3B, disc members 46 are separated by section 19B of housing bottom portion 19. In one embodiment, housing 18 is formed with a top half section and a bottom half section wherein the top half section is press-fitted onto the bottom half section. For example, in one embodiment, the top half section comprises upper tier section 21 and intermediate section 23, and the bottom half section comprises base tier section 22 and intermediate section 24. In such an embodiment, disc members 46 are inserted into the bottom half section prior to the top half section being attached to the bottom half section. Specifically, disc members 46 are positioned so that the perimetrical edges of disc members 46 are positioned within channels 48 and each disc member 46 is positioned over a corresponding opening 25. Once disc members 46 are correctly positioned, the explosive material 80 is packed into the bottom half of housing 18 such that the explosive material 80 covers and contacts disc members 46. Explosive material 80 is packed into the interior of the top half of housing 18. The top half of housing 18 is then press-fitted onto the bottom half of housing 18. As a result of the structure of disc members 46 and the locations of openings 25, air pockets 47 are formed between each disc 46 and exterior surface 16 of munition casing 14 (see FIG. 3B).

In another exemplary embodiment, bottom portion 19 of housing 18 is a separate piece which can be press-fitted to the base tier section 22. In such an embodiment, interior 34 of housing 18 is first packed with explosive material 80. Next, disc members 46 are positioned so that the perimetrical edge of each disc member 46 is within a corresponding channel 48 as shown in FIGS. 3A, 3B and 3C and each disc member 46 is positioned over a corresponding opening 25. Bottom portion 19 is press-fitted to the rest of housing 18. Once bottom portion 19 is completely press-fitted to the rest of housing 18, each disc member 46 physically contacts the explosive material 80.

In order to use apparatus 10, an energetic device 37 is disposed into interior space 36 of extending section 35 (see FIG. 5) such that it contacts, and preferably penetrates, explosive material 80 in interior 34. Detonation cord 90 extends through a through-hole in fastening device 39 and is connected to energetic device 37. Fastening device 39 is engaged to threaded portion 38 of extending section 35. Detonation cord 90 can be any suitable detonation cord. In an exemplary embodiment, detonation cord 90 explodes when activated thereby detonating energetic device 37. In another exemplary embodiment, detonation cord 90 is configured to conduct an electrical signal that detonates energetic device 37. Other suitable types of detonation cords may be used. Detonation of energetic device 37 causes detonation of plastic explosive material 80. Detonation of plastic explosive material 80 deforms disc members 46 such that disc members 46 impact or slap munition casing 14 thereby producing high-magnitude shock waves that pass through the munition casing 14 and cause munition 12 to detonate.

The thickness "T2" (see FIG. 3C) of each disc member 46 determines the duration of loading or pressure produced by the impact of disc members 46 upon munition casing 14. In an exemplary embodiment, each disc member 46 has a thickness "T2" of about 0.125 inch.

Figure 4A:
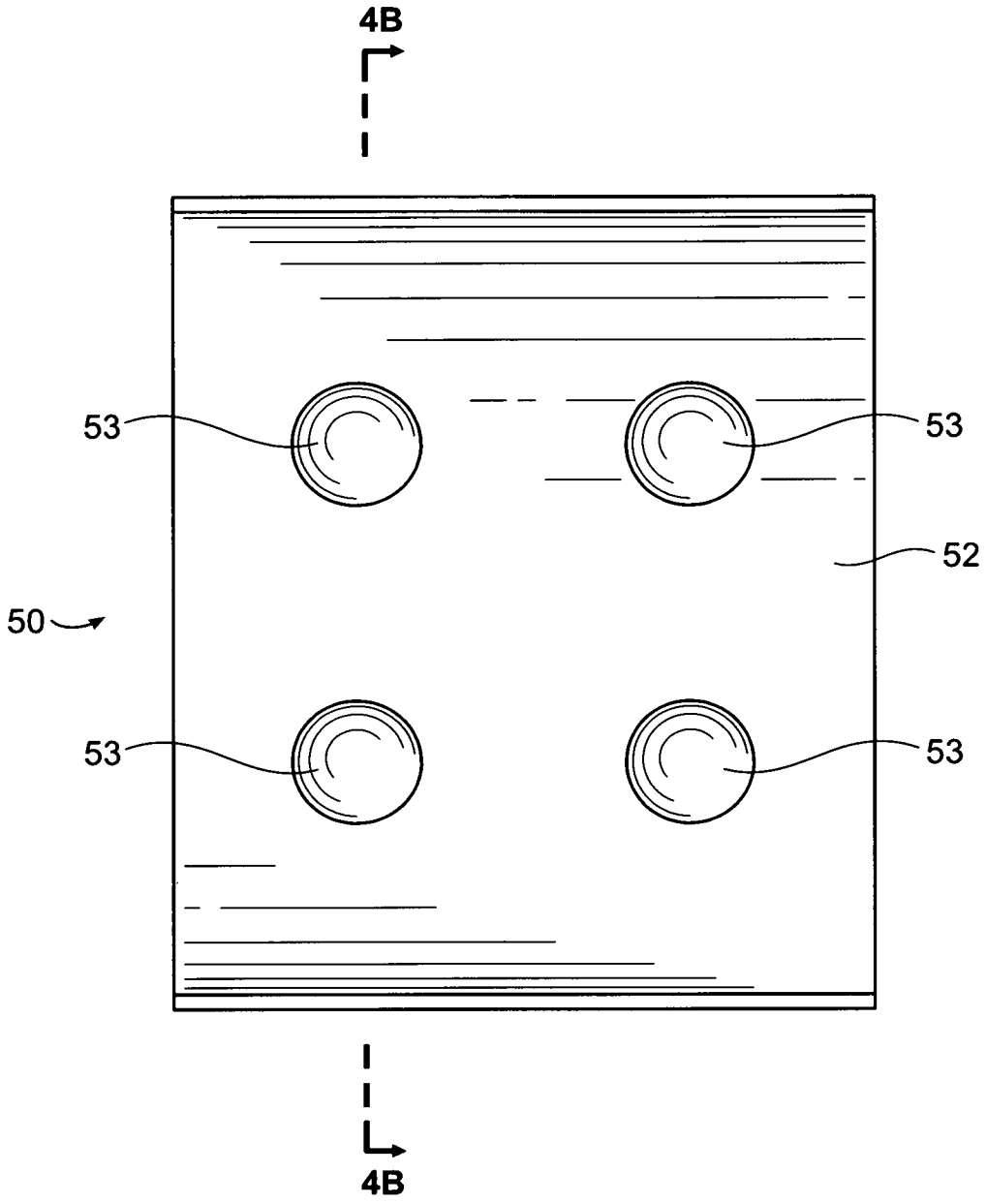
FIG. 4A is a perspective view of a plate member that is part of an apparatus for detonating munitions in accordance with another embodiment of the invention.
Figure 4B:
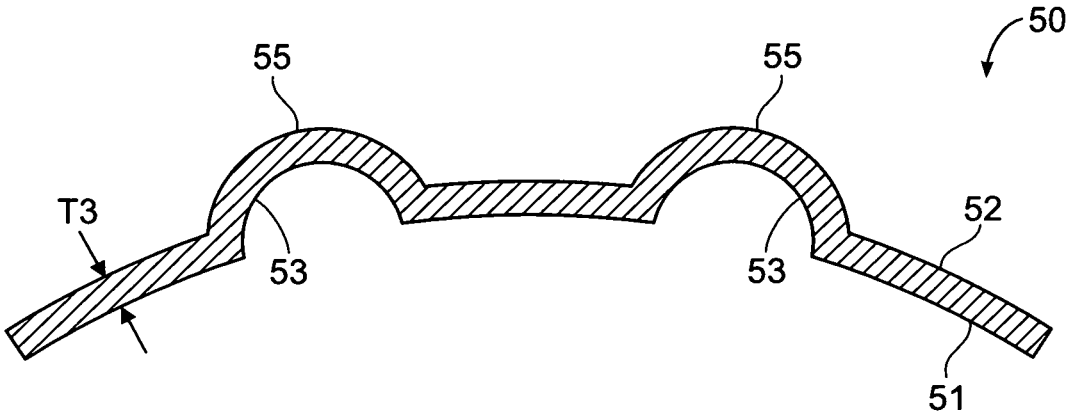
FIG. 4B is a cross-sectional view taken along line 4B-4B in FIG. 4A.
Figure 4C:
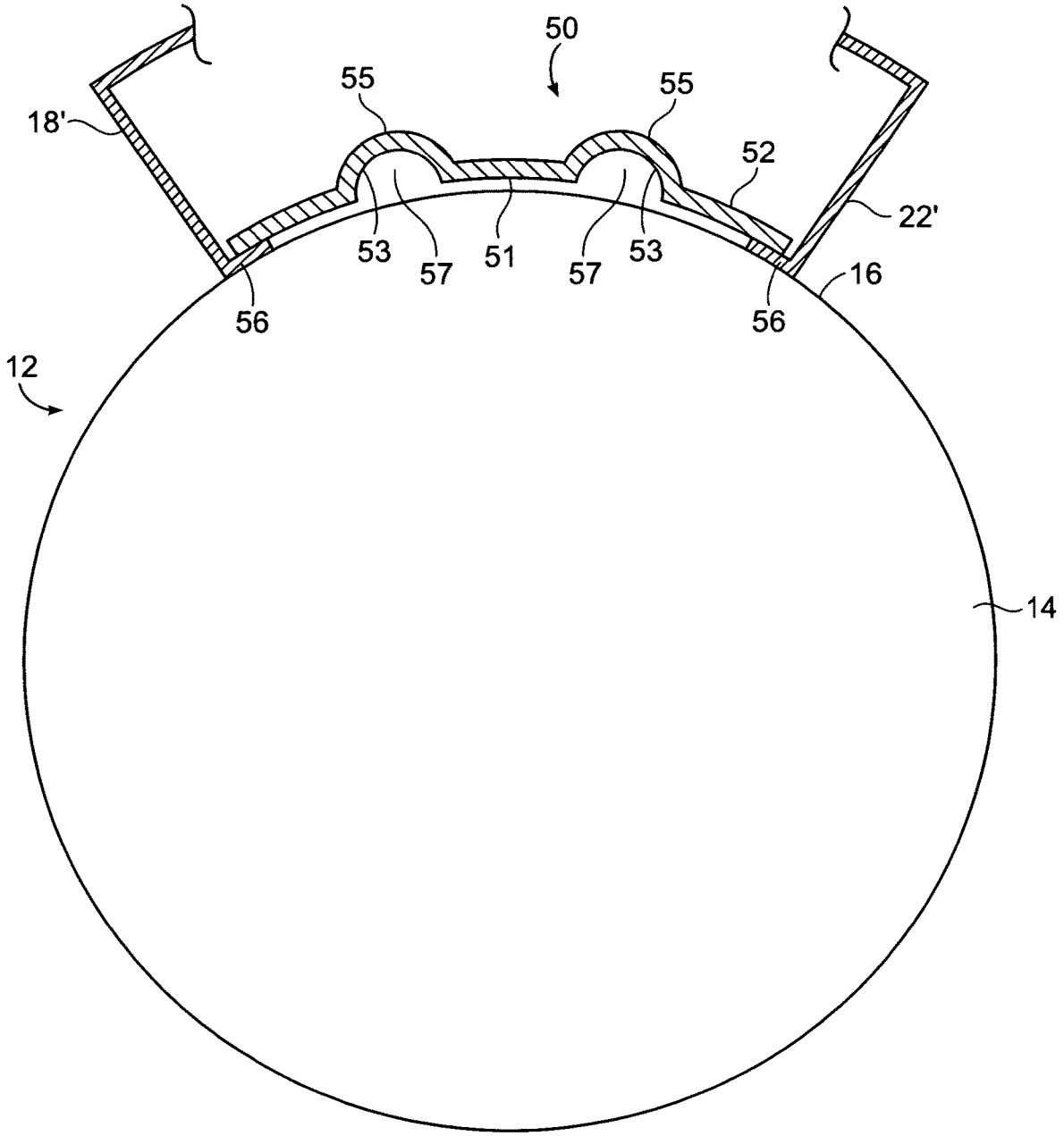
FIG. 4C is a cross-sectional view of a portion of an alternate embodiment of the apparatus for detonating munitions.
Figure 5:
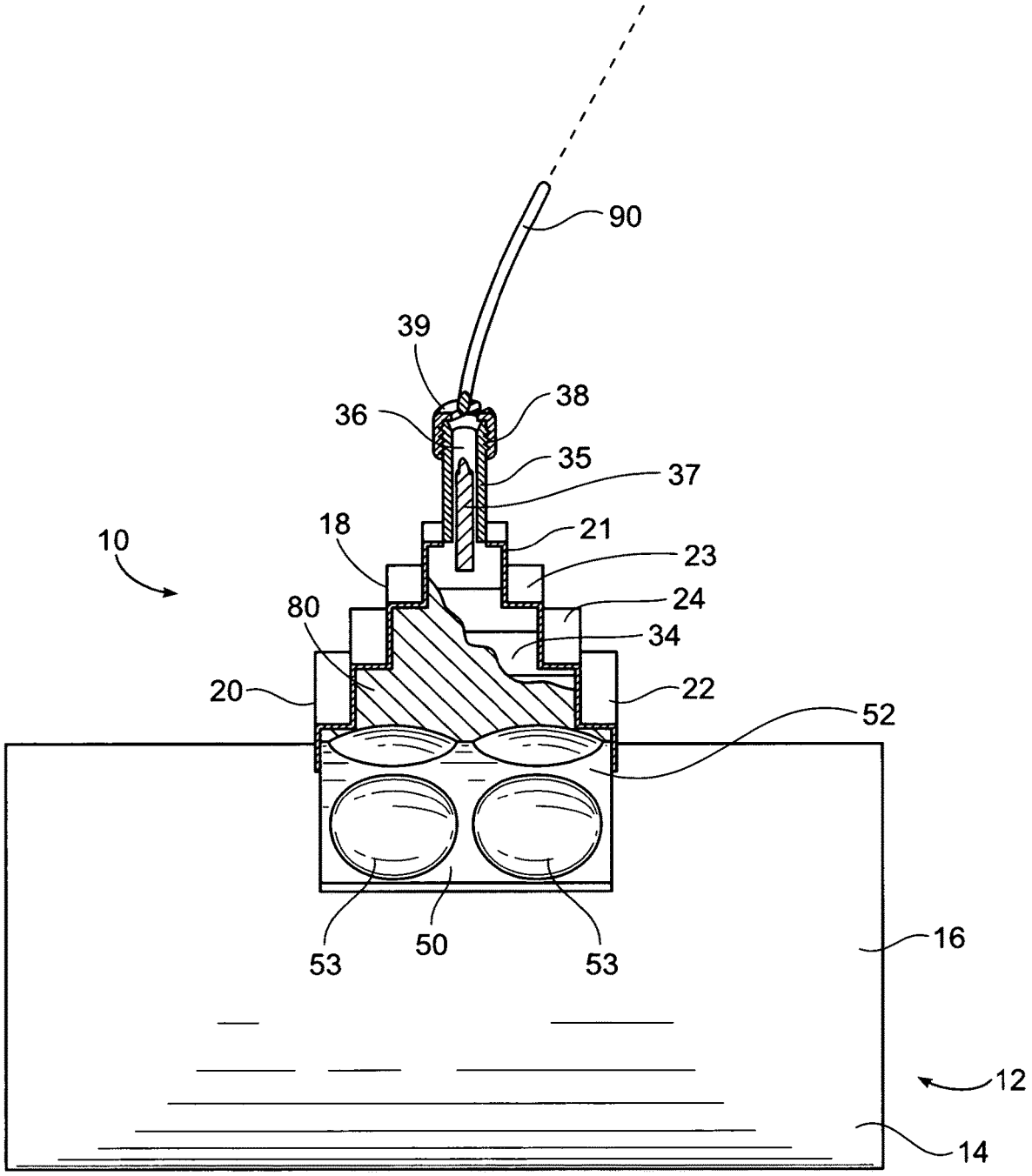
FIG. 5 is a front view of the apparatus and munition, the housing of the apparatus being shown partially in cross-section to allow viewing of the interior of the housing and the plate member shown in FIGS. 4A and 4B.

Referring to FIGS. 4A, 4B and 5, there is shown another exemplary embodiment of the invention. In this embodiment, the force-reactive component includes plate member 50 instead of the separate disc members 46. In an exemplary embodiment, plate member 50 comprises a single sheet that has a curvature that corresponds to the curvature of munition casing 14. In an exemplary embodiment, plate member 50 is fabricated from metal. Suitable metals include steel, iron, aluminum, nickel, copper and brass. Plate member 50 has front side 51, rear side 52 and one or more dimples or cavities 53 formed therein. Dimples 53 are formed during fabrication of plate member 50 by any suitable technique or method. Each dimple 53 includes force-receiving portion 55 that is exposed to interior 34 and explosive material 80. The force-receiving portion 55 encompasses the peak or apex portion of dimple 53. Plate member 50 may be attached to the bottom of housing 18 by any one of a variety of techniques including, but not limited to, adhesive tape, clips, screws and other adhesives materials. As shown in FIG. 4C, front side 51 of plate member 50 confronts exterior surface 16 of munition casing 14 when apparatus 10 is positioned on munition casing 12.

In another exemplary embodiment of apparatus 10, base tier section 22 is formed with lips that support plate member 50. This embodiment is shown in FIG. 4C. Housing 18' has substantially the same structure as housing 18 shown in FIG. 3B except housing 18' does not have bottom portion 19 but instead, has a modified base tier section 22', which includes lips 56 that support plate member 50. In an exemplary embodiment, each lip 56 has thickness of about 0.125 inch. For purposes of simplification, only a portion of housing 18' is shown and explosive material 80 is not shown. In this embodiment, housing 18' comprises a bottom half section and a top half section that is press-fitted to the bottom half section. Plate member 50 is inserted into bottom half section and positioned on lips 56. The explosive material 80 is packed into the top half section and then packed into the bottom half section such that explosive material 80 contacts force-receiving portions 55. The top half section is then press-fitted to bottom half section.

In alternate embodiments, the bottom of housing 18 is configured with widthwise channels (not shown) sized to receive the widthwise ends of plate member 50.

In one exemplary embodiment, plate member 50 is made from a malleable or bendable metal that may be manually shaped to have a curvature that corresponds to or matches the curvature of munition casing 14. In other embodiments, plate member 50 is not bendable or malleable but is stiff and is fabricated with a predetermined curvature. As a result of the structure of plate member 50, air-pockets 57 are created when plate member 50 is positioned on exterior surface 16 of munition casing 14. Although plate member 50 is shown with four dimples 53, it is to be understood that plate member 50 can be configured with just one dimple 53 or more than four dimples 53. The size of dimples 53 may be varied as well. For example, in one exemplary embodiment, there is a large, single, centrally located dimpled portion 53. In another exemplary embodiment, there are three smaller sized dimpled portions 53. Plate member 53 may be fabricated from any one of a variety of suitable metals, including steel, aluminum, brass, copper and nickel.

As will be further explained in the ensuing description, detonation of the explosive material 80 produces a force that deforms dimples 53 so that dimples 53 collapse and impact or slap exterior surface 16 of munition casing 14 thereby producing high-magnitude shockwaves that pass through munition casing 14 and cause detonation of munition 12. Air-pockets 57 allow dimples 53 to collapse and deform upon detonation of explosive material 80 and impact munition casing 14. The thickness T3 of plate member 50 determines the duration of loading or pressure produced by the impact of dimples 53 upon munition casing 14 (see FIG. 4B). In one example, plate member 50 has a thickness T3 of about 0.125 inch. However, plate member 50 may be configured to have a thickness T3 greater than or less than 0.0125 inch.

Figures 6A, 6B:
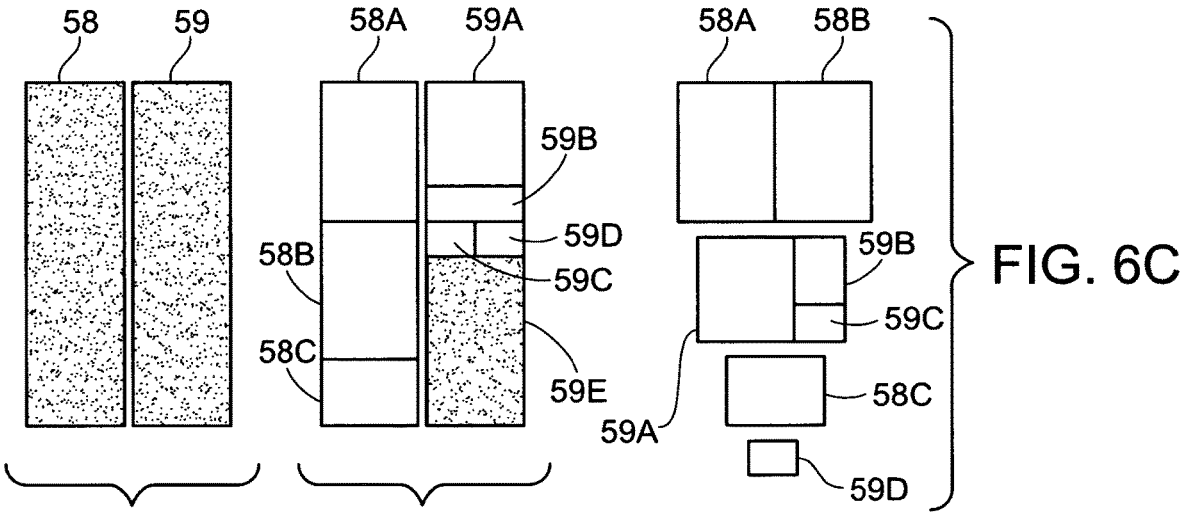
FIG. 6A is a diagram showing blocks of plastic explosive material, portions of which are packed into the interior of the pyramidal shaped housing, wherein the pyramidal shaped housing has a first predetermined size in accordance with one exemplary embodiment.
FIG. 6B is a diagram showing the portions of the blocks of plastic explosive material that are actually used to completely pack the interior of the pyramidal shaped housing having the first predetermined size.

The size of pyramidal shaped housing 18 determines the amount of explosive material 80 needed to completely fill interior 34. For example, as shown in FIGS. 6A-C, if interior 34 has a first predetermined volume based on base tier section 22 having a width or depth of four inches, then 1½ blocks of plastic explosive material, such as M112 (or C4), are needed to pack interior 34. FIG. 6A shows two uncut blocks 58 and 59 of plastic explosive material. As shown in FIG. 6B, all of block 58 is used which is represented by portions 58A-C. Approximately half of block 59 is used and is represented by portions 59A-D. Portion 59E of block 59 is not used. FIG. 6C shows the arrangement of portions 58A-C and portions 59A-D when packed into interior 34.

Figures 7A, 7B, 7C:
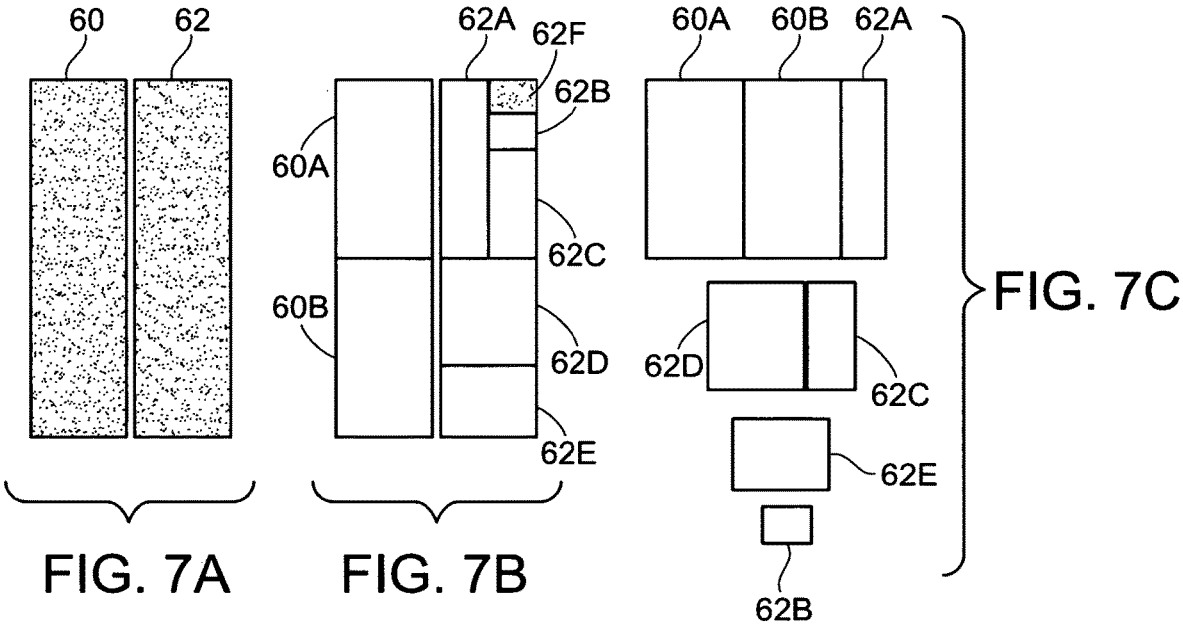
FIG. 7A is a diagram showing blocks of plastic explosive material, portions of which are packed into the interior of the pyramidal shaped housing, wherein the pyramidal shaped housing has a second predetermined size in accordance with another exemplary embodiment.
FIG. 7B is a diagram showing the portions of the blocks of plastic explosive material of FIG. 7A that are actually used to completely pack the interior of the pyramidal shaped housing having the second predetermined size.
FIG. 7C is an exploded view showing the arrangement of the portions of the plastic explosive material when packed into the interior of the pyramidal shaped housing having the second predetermined size.

In another example, shown in FIGS. 7A-C, if the interior 34 has a second predetermined volume based on base tier section 22 having a width or depth of five inches, then substantially all of two blocks of plastic explosive are needed to pack interior 34. FIG. 7A shows two uncut blocks 60 and 62 of plastic explosive. As shown in FIG. 7B, all of block 60 is used which is represented by portions 60A-B. Substantially all of block 62 is used and is represented by portions 62A-E. Portion 62F of block 62 is not used. FIG. 7C shows the arrangement of portions 60A-B and portions 62A-E when packed into interior 34.

Figure 8A:
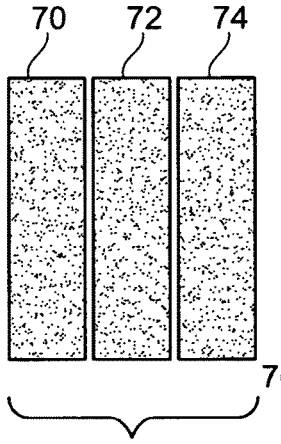
FIG. 8A is a diagram showing blocks of plastic explosive material, portions of which are packed into the interior of the pyramidal shaped housing, wherein the pyramidal shaped housing has a third predetermined size in accordance with a further exemplary embodiment.
Figure 8B:
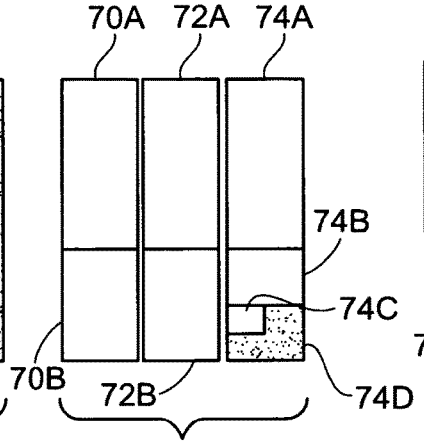
FIG. 8B is a diagram showing portions of the blocks of plastic explosive material of FIG. 8A that are actually used to completely pack the interior of the pyramidal shaped housing having the third predetermined size.
Figure 8C:
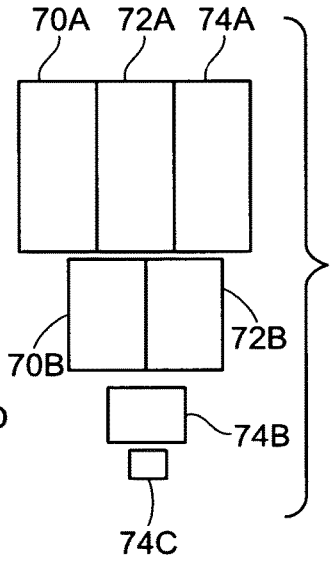
FIG. 8C is an exploded view showing the arrangement of the portions of the plastic explosive material when packed into the interior of the pyramidal shaped housing having the third predetermined size.

In another example, shown in FIGS. 8A-C, if interior 34 has a third predetermined volume based on base tier section 22 having a width or depth of six inches, then substantially all of three blocks of plastic explosive are needed to pack interior 34. FIG. 8A shows three uncut blocks 70, 72 and 74 of plastic explosive. As shown in FIG. 8B, all of block 70 is used which is represented by portions 70A-B and all of block 72 is used which is represented by portions 72A-B. Substantially all of block 74 is used and is represented by portions 74A-C. Portion 74D of block 74 is not used. FIG. 8C shows the arrangement of portions 70A-B, 72A-B and portions 74A-C when packed into interior 34.

Although the foregoing description is in terms of the plastic explosive being M112 (C4), it is to be understood that other types of plastic explosive materials may be used. It is also to be understood that the size of housing 18 can have other dimensions as well and therefore can have a base tier section 22 with a width or depth less than four inches or more than six inches.

When interior 34 is packed with explosive material 80 and energetic device 37 is positioned within space 36 of extending section 35 and detonation cord 90 is attached to energetic device 37 and secured by fastening device 39, then apparatus 10 is ready to be used. Apparatus 10 is then mounted or positioned on munition casing 14. Activation or detonation cord 90 causes detonation of energetic device 37. Detonation of energetic device 37 causes detonation of plastic explosive material 80. As described in the foregoing description, detonation of plastic explosive material 80 deforms disc members 46 such that disc members 46 impact or slap munition casing 14 thereby producing high-magnitude shock waves that pass through the munition casing 14 and cause munition 12 to detonate. Openings 25 and air-pockets 47 allow disc members 46 to function as flyer plates upon detonation of explosive material 80. When plate member 50 is used instead of disc members 46, the detonation of explosive material 80 produces a force that deforms dimples 53 causing the dimples to collapse and impact or slap exterior surface 16 of munition casing 14 thereby producing high-magnitude shock waves that pass through munition casing 14 and cause detonation of munition 12. Air-pockets 57 allow dimples 53 to function as flyer plates upon detonation of explosive material 80.

Although the foregoing description is in terms of munition 12 having a generally cylindrical casing or body, it is to be understood that the apparatus 10 may be used with munitions having different shapes. For example, apparatus 10 may be configured to be used with munitions that have flat casings or bodies. In such a scenario, housing 18 is configured without any curvature in tier sections 21, 22, 23 and 24, and plate member 50, if used instead of disc members 46, is configured without any curvature.

The foregoing description, for purpose of explanation, has been described with reference to specific exemplary embodiments. However, the illustrative discussions above are not intended to be exhaustive or to limit the invention to the precise forms disclosed. Many modifications and variations are possible in view of the above teachings. The exemplary embodiments were chosen and described in order to best explain the principles of the invention and its practical applications, to thereby enable others skilled in the art to best utilize the invention and various embodiments with various modifications as are suited to the particular use contemplated.

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. An apparatus for detonating a munition having a munition casing, the apparatus comprising:

a pyramidal shaped housing including a hollow interior being configured for receiving an explosive material and a stepped structure defining a plurality of tier sections, the plurality of tier sections comprise a base tier section, an upper tier section and at least one intermediate tier section, wherein the base tier section is relatively larger in size than both the intermediate tier section and the upper tier section, wherein the intermediate tier section is relatively larger in size than the upper tier section, wherein the pyramidal shaped housing includes a bottom portion contiguous with the base tier section, and wherein the pyramidal shaped housing further includes an additional space that is part of the interior and which is configured to receive an energetic device; and a force-reactive component being secured to the bottom portion of the housing so that the force-reactive component confronts the munition casing, the force-reactive component includes a force-receiving portion exposed to the interior of the pyramidal shaped housing, wherein the force-reactive component is configured to impact the munition casing when a force is exerted upon the force-receiving portion, and wherein when the apparatus is positioned on the munition casing and explosive material is packed into the interior of the pyramidal shaped housing and an energetic device is disposed within the additional space, detonation of the energetic device causes detonation of the explosive material to produce a force upon the force-receiving portion of the force-reactive component to cause the force-reactive component to impact the munition casing thereby to produce shock waves that permeate the munition casing and cause the munition to detonate.

2. The apparatus according to claim 1, wherein the at least one intermediate tier section comprises a plurality of intermediate tier sections, wherein an uppermost intermediate tier section is contiguous with and larger than the upper tier section and each successive intermediate tier section is larger than the previous intermediate tier section, and wherein a lowermost intermediate tier section is contiguous with and smaller than the base tier section.

3. The apparatus according to claim 2, wherein the plurality of intermediate tier sections comprises three intermediate tier sections.

4. The apparatus according to claim 1, wherein the apparatus is configured for placement on a munition casing having a curvature, and wherein the base tier section, intermediate tier sections and the upper tier section each have a curvature, which corresponds to the curvature of the munition casing.

5. The apparatus according to claim 1, wherein the apparatus is configured for placement on a munition casing having a curvature, and wherein the base tier section has a curvature that corresponds to the curvature of the munition casing.

6. The apparatus according to claim 1, wherein the bottom portion of the housing has an opening that confronts the munition casing, wherein the force-reactive component comprises at least one disc member within the interior of the housing and positioned over the opening in the bottom portion, whereby detonation of the explosive material deforms the disc member so that the disc member impacts the munition casing and produces the shock waves.

7. The apparatus according to claim 6, wherein the disc member has a generally arc-shaped and a peak portion exposed to the interior of the housing.

8. The apparatus according to claim 6, wherein the bottom portion of the housing has a plurality of openings and the at least one disc member comprises a plurality of disc members, and wherein each disc member is positioned over a corresponding opening.

9. The apparatus according to claim 6, wherein the disc member is a metal disc member.

10. The apparatus according to claim 1, wherein the force-reactive component comprises a plate member that is secured to the bottom portion of the housing, wherein the plate member includes at least one dimple having a peak portion that is exposed to the interior of the housing, whereby detonation of the explosive material produces a force that deforms the dimple so that it impacts the munition casing and produces the shock waves.

11. The apparatus according to claim 10, wherein the at least one dimple comprises a plurality of dimples.

12. The apparatus according to claim 10, wherein the at least one dimple is centrally located on the plate member.

13. The apparatus according to claim 10, wherein the plate member is a metal plate member.

14. The apparatus according to claim 1, wherein the pyramidal shaped housing is fabricated from one of acrylonitrile butadiene styrene, plastic, rubber, resin, polyvinyl chloride (PVC) and composite materials.

15. The apparatus according to claim 1, wherein the housing includes an extending section contiguous with the upper tier section to provide additional space.

16. The apparatus according to claim 1, further comprising plastic explosive material being packed into the interior of the pyramidal shaped housing.

17. The apparatus according to claim 16, further including an energetic device being disposed within the additional space and being in physical contact with the explosive material.

18. An apparatus for detonating a munition having a munition casing, comprising:

a pyramidal shaped housing including a hollow interior being configured for receiving an explosive material and a stepped structure defining a plurality of tier sections, wherein the plurality of tier sections includes a base tier section, an upper tier section and at least one intermediate tier section, wherein the base tier section is relatively larger in size than both the intermediate tier section and the upper tier section, wherein the intermediate tier section is relatively larger in size than the upper tier section, wherein the pyramidal shaped housing includes a bottom portion contiguous with the base tier section, and wherein the pyramidal shaped housing further includes an additional space that is part of the interior and configured to receive an energetic device; and a force-reactive component being secured to the bottom portion of the housing so that the force-reactive component confronts the munition casing, wherein the force-reactive component includes a force-receiving portion exposed to the interior of the pyramidal shaped housing, wherein the force-reactive component is configured to impact the munition casing when a force is exerted upon the force-receiving portion, wherein the force-reactive component comprises a plate member that is secured to the bottom portion of the housing and which includes at least one dimple having a peak portion exposed to the interior of the housing, and wherein when the explosive material is packed into the interior of the pyramidal shaped housing and an energetic device is disposed within the additional space, the detonation of the energetic device causes detonation of the explosive material to produce a force upon the force-receiving portion of the dimple to thereby deform the dimple so that it impacts the munition casing and produces shock waves that permeate the munition casing and cause the munition to detonate.

19. The apparatus according to claim 18, wherein the at least one dimple comprises a plurality of dimples.

20. An apparatus for detonating a munition having a munition casing, comprising:

a pyramidal shaped housing including a hollow interior being configured for receiving an explosive material and a stepped structure defining a plurality of tier sections, wherein the plurality of tier sections includes a base tier section, an upper tier section and at least one intermediate tier section, wherein the base tier section is relatively larger in size than both the intermediate tier section and the upper tier section, wherein the intermediate tier section is relatively larger in size than the upper tier section, wherein the pyramidal shaped housing includes a bottom portion that is contiguous with the base tier section and which has at least one opening, and wherein the pyramidal shaped housing further includes an additional space that is part of the interior and configured for receiving an energetic device; and a force-reactive component being secured to the bottom portion of the housing so that the force-reactive component confronts the munition casing, wherein the force-receiving component includes a force-receiving portion exposed to the interior of the pyramidal shaped housing, wherein the force-reactive component is configured to impact the munition casing when a force is exerted upon the force-receiving portion, wherein the force-reactive component comprises at least one disc member within the interior of the housing and positioned over the opening in the bottom portion, and wherein when explosive material is packed into the hollow interior of the pyramidal shaped housing and an energetic device is disposed within the additional space, the detonation of the energetic device causes detonation of the explosive material which produces a force upon the force-receiving portion of the disc member to thereby deform the disc member such that the disc member impacts the munition casing and produces shock waves that permeate the munition casing and cause the munition to detonate.

21. The apparatus according to claim 20, wherein the bottom portion of the housing includes a plurality of openings, and the at least one disc member comprises a plurality of disc members, and wherein each disc member is positioned over a corresponding opening in the bottom portion.

* * * * *